US010570902B2

(12) United States Patent
Ma et al.

(10) Patent No.: US 10,570,902 B2
(45) Date of Patent: Feb. 25, 2020

(54) BAND-GAP COMMUNICATIONS ACROSS A WELL TOOL WITH A MODIFIED EXTERIOR

(71) Applicant: HALLIBURTON ENERGY SERVICES, INC., Houston, TX (US)

(72) Inventors: Jin Ma, Singapore (SG); Wei Hsuan Huang, Singapore (SG); Glenn Andrew Wilson, Singapore (SG); Iftikhar Ahmed, Singapore (SG)

(73) Assignee: Halliburton Energy Services, Houston, TX (US)

( * ) Notice: Subject to any disclaimer, the term of this patent is extended or adjusted under 35 U.S.C. 154(b) by 310 days.

(21) Appl. No.: 15/533,212

(22) PCT Filed: Dec. 29, 2014

(86) PCT No.: PCT/US2014/072496

§ 371 (c)(1),
(2) Date: Jun. 5, 2017

(87) PCT Pub. No.: WO2016/108811

PCT Pub. Date: Jul. 7, 2016

(65) Prior Publication Data

US 2017/0342986 A1 Nov. 30, 2017

(51) Int. Cl.
*E21B 47/12* (2012.01)
*F04D 13/02* (2006.01)
(Continued)

(52) U.S. Cl.
CPC ..... *F04D 13/024* (2013.01); *E21B 47/122* (2013.01); *E21B 4/003* (2013.01); *E21B 4/02* (2013.01); *E21B 47/18* (2013.01)

(58) Field of Classification Search
None
See application file for complete search history.

(56) References Cited

U.S. PATENT DOCUMENTS 4,015,234 A 3/1977 Krebs
4,051,897 A 10/1977 Kingelin et al.
(Continued)

FOREIGN PATENT DOCUMENTS

WO 2014047543 3/2014
WO 2014133504 9/2014
WO 2016108816 7/2016

OTHER PUBLICATIONS

Halliburton , "Geo-Pilot GXT Rotary Steerable System", available at http://www.halliburton.com/en-US/ps/sperry/drilling/directional-drilling/rotary-steerables/geo-pilot-gxt-rotary-steerable-system. page, at least as early as Apr. 4, 2017, 1 page.
(Continued)

*Primary Examiner* — Clayton E. LaBalle
*Assistant Examiner* — Jas A Sanghera
(74) *Attorney, Agent, or Firm* — Kilpatrick Townsend & Stockton LLP

(57) ABSTRACT

A communication system can include a first subsystem of a well tool that can include a first cylindrically shaped band positioned around the first subsystem. The first cylindrically shaped band can be operable to electromagnetically couple with a second cylindrically shaped band. The communication system can also include a second subsystem of the well tool. The second subsystem can include the second cylindrically shaped band positioned around the second subsystem. The communication system can further include an intermediate subsystem positioned between the first subsystem and the second subsystem. The intermediate subsystem can include an insulator positioned coaxially around the intermediate subsystem.

21 Claims, 13 Drawing Sheets

(51) Int. Cl.

| | |
|---|---|
| *E21B 4/00* | (2006.01) |
| *E21B 4/02* | (2006.01) |
| *E21B 47/18* | (2012.01) |

(56) References Cited

U.S. PATENT DOCUMENTS

| | | | | |
|---|---|---|---|---|
| 4,286,217 | A * | 8/1981 | Planche | G01V 3/20 324/347 |
| 4,693,534 | A | 9/1987 | Clark et al. | |
| 4,712,070 | A | 12/1987 | Clark et al. | |
| 4,785,247 | A | 11/1988 | Meador et al. | |
| 5,160,925 | A | 11/1992 | Dailey et al. | |
| 5,235,285 | A * | 8/1993 | Clark | E21B 17/1078 324/342 |
| 5,339,037 | A | 8/1994 | Bonner et al. | |
| 7,098,802 | B2 | 8/2006 | Hall et al. | |
| 7,252,160 | B2 | 8/2007 | Dopf et al. | |
| 7,277,026 | B2 | 10/2007 | Hall et al. | |
| 7,303,007 | B2 | 12/2007 | Konschuh et al. | |
| 7,518,528 | B2 | 4/2009 | Price et al. | |
| 8,242,928 | B2 | 8/2012 | Prammer | |
| 8,258,976 | B2 | 9/2012 | Price et al. | |
| 2004/0113808 | A1 | 6/2004 | Hall et al. | |
| 2005/0087368 | A1 | 4/2005 | Boyle et al. | |
| 2005/0146334 | A1* | 7/2005 | Chen | G01V 3/28 324/338 |
| 2006/0151179 | A1 | 7/2006 | Boyadjieff et al. | |
| 2008/0253228 | A1 | 10/2008 | Camwell et al. | |
| 2009/0045974 | A1 | 2/2009 | Patel | |
| 2011/0254695 | A1 | 10/2011 | Camwell et al. | |
| 2012/0090827 | A1* | 4/2012 | Sugiura | E21B 17/028 166/65.1 |
| 2012/0199730 | A1 | 8/2012 | Chirovsky et al. | |
| 2012/0299743 | A1 | 11/2012 | Price et al. | |
| 2013/0088364 | A1 | 4/2013 | Bittar et al. | |
| 2014/0132271 | A1 | 5/2014 | Liu et al. | |
| 2014/0240141 | A1 | 8/2014 | Logan et al. | |

OTHER PUBLICATIONS

International Patent Application No. PCT/US2014/072496, International Search Report and Written Opinion, dated Sep. 1, 2015, 10 pages.

Reeves et al., "High Speed Acoustic Telemetry Network Enables Real-Time Along String Measurements, Greatly Reducing Drilling Risk", 2011, pp. 12.

Schlumberger Company , "PZIG At-bit inclination and gama ray service", available at http://www.slb.com/~/media/Files/drilling/product_sheets/mwd/pathfinder_mwd/pzig_at_bit_gr_measurements_ps.pdf, retrieved on Oct. 2016, 2 pages.

Scientific Drilling , "Sci-Driver Near Bit Instrumented Motor", available at http://scientificdrilling.com/content/uploads/2014/01/Product-Spec-Sheet_LWD_Sci-Driver_Smart-Motor.pdf, retrieved on Oct. 2016, 1 page.

* cited by examiner

BAND-GAP COMMUNICATIONS ACROSS A WELL TOOL WITH A MODIFIED EXTERIOR

CROSS-REFERENCE TO RELATED APPLICATION

This is a U.S. national phase under 35 U.S.C. 371 of International Patent Application No. PCT/US2014/072496, titled "Band-Gap Communications Across a Well Tool with a Modified Exterior" and filed Dec. 29, 2014, the entirety of which is incorporated herein by reference.

TECHNICAL FIELD

The present disclosure relates generally to devices for use in well systems. More specifically, but not by way of limitation, this disclosure relates to band-gap communications across a well tool with a modified exterior.

BACKGROUND

A well system (e.g., an oil or gas well for extracting fluid or gas from a subterranean formation) can include various well tools in a wellbore. It can be desirable to communicate data between the well tools. In some examples, a cable can be used to transmit data between the well tools. The cable can wear or fail, however, as the well components rotate and vibrate to perform functions in the wellbore. In other examples, the well tools can wirelessly transmit data to each other. The power transmission efficiency of a wireless communication, however, can depend on a variety of factors that may be impractical or infeasible to control. For example, the power transmission efficiency of a wireless communication can depend on the conductive characteristics of the subterranean formation. It can be challenging to wirelessly communicate between well tools efficiently.

DETAILED DESCRIPTION

Figure 1:
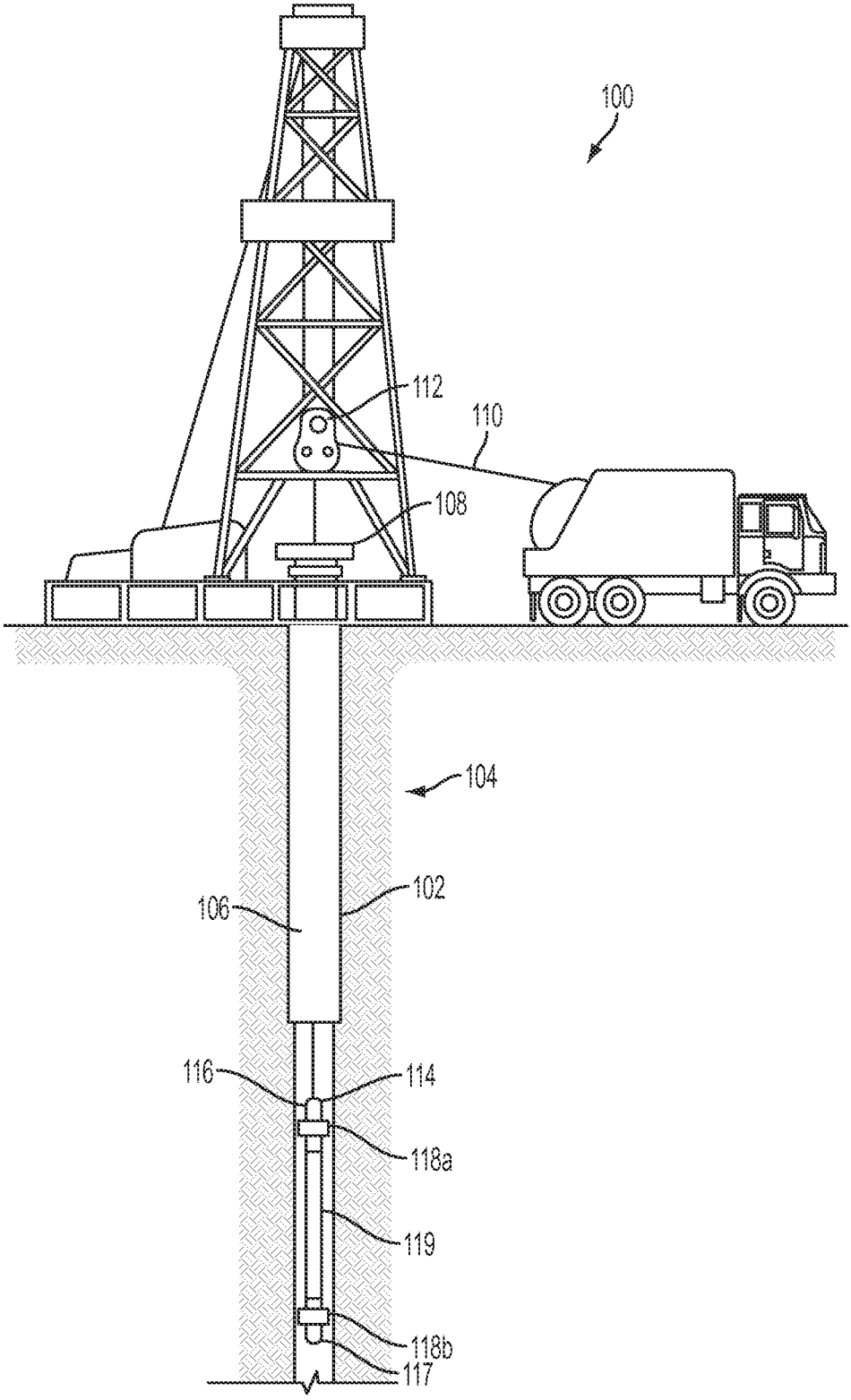
FIG. 1 depicts a well system that includes band-gap transceivers for band-gap communications across a well tool with a modified exterior according to one example.

Certain aspects and features of the present disclosure are directed to band-gap communications across a well tool with a modified exterior. The band-gap communications can be between two transceivers. One transceiver can include a cylindrically shaped band positioned around (e.g., positioned coaxially around) a subsystem of the well tool. The other transceiver can include a cylindrically shaped band positioned around another subsystem of the well tool.

The transceivers can electromagnetically communicate (e.g., wirelessly communicate using electromagnetic fields) with each other via the cylindrically shaped bands. For example, power can be supplied to the cylindrically shaped band of one transceiver. The power can generate a voltage between the cylindrically shaped band and the outer housing of the associated subsystem. The voltage can cause the cylindrically shaped band to radiate an electromagnetic field through a fluid in the wellbore and the surrounding formation (e.g., the subterranean formation). The voltage can also cause the cylindrically shaped band to transmit current into the fluid in the wellbore and the surrounding formation. If the fluid and formation have a high resistivity, the current transmitted into the fluid and formation can attenuate and the other transceiver can detect the electromagnetic field emitted by the transceiver. If the fluid and formation have a low resistivity, the electromagnetic field emitted by the transceiver can attenuate and the other transceiver can detect the current transmitted through the fluid and the formation. The transceivers can wirelessly communicate (e.g., wirelessly couple) in low resistivity and high resistivity downhole environments.

In some examples, the cylindrical shape of the bands can improve the power transmission efficiency of the communication system. For example, the one subsystem may rotate at a different speed and in a different direction than another subsystem. If the transceivers use, for example, asymmetrically-shaped electrodes positioned on the subsystems, the electrodes can rotate out of alignment with each other due to the differing speeds and directions of rotation of the subsystems. When the electrodes are misaligned, electromagnetic communications between the electrodes may not be effective because the signal received by the misaligned transceiver may not be detected properly. This can cause unexpected fluctuations in the strength of the received signals during the rotation of the subsystem, which can reduce the signal detection efficiency of the communication system. Conversely, the cylindrically shaped bands cannot rotate out of alignment with one another, because each of the cylindrically shaped bands traverses the entire circumference of its associated subsystem. This can allow wireless communications to travel shorter distances and without interference from the well tool. This can improve the signal detection efficiency of the communication system and provide for a more stable communication system.

In some examples, an intermediate subsystem (e.g., a mud motor) can be positioned between the transceivers. Because the intermediate subsystem can be long (e.g., 40 feet or more), the distance between the transceivers may cause electromagnetic communications between the transceivers to attenuate. This can affect the power transmission efficiency of the communication system. Further, as the electromagnetic field and/or current passes through the fluid and formation, the electromagnetic field and/or current can electrically interact with the housing of the intermediate subsystem. For example, a portion of the current can electrically short to through the housing of the intermediate subsystem, reducing the amount of current that reaches the receiving transceiver. This may cause the electromagnetic field and/or current to attenuate, reducing the power transmission efficiency of the communication system.

To reduce the attenuation due to the distance between the transceivers, in some examples, the exterior of the intermediate subsystem can be modified. For example, the exterior can include an insulator layer positioned around (e.g., positioned coaxially around) the outer housing of the intermediate subsystem and traversing the entire longitudinal length of the intermediate subsystem. This can prevent the current from electrically shorting through the outer housing of the intermediate subsystem. A metal sleeve can be positioned around the insulator layer (e.g., to protect the insulator layer from damage). In some examples, the insulator layer can include multiple insulative rings (e.g., O rings) positioned between the outer housing of the intermediate subsystem and the metal sleeve. The insulative rings can create a space between the intermediate subsystem and the metal sleeve. This can electrically insulate the metal sleeve from the outer housing of the intermediate subsystem. The metal sleeve can act as an electrical shield, preventing current from electrically interacting with the outer housing of the intermediate subsystem. In some examples, insulative buffers can be positioned around the outer housing of the intermediate subsystem and adjacent to each longitudinal end of the metal sleeve. This can help prevent the metal sleeve from contacting metal components (e.g., a tubular joint) adjacent to the metal sleeve and the intermediate subsystem, thereby maintaining the metal sleeve's electrical isolation.

In one example, the well tool can include a logging-while-drilling tool and the intermediate subsystem can include a mud motor. The mud motor can include a modified exterior that includes an insulator positioned around an outer housing of the mud motor. A metal sleeve can be positioned around the insulator. To transmit an electromagnetic communication, one transceiver can apply a voltage to its cylindrically shaped band. This can generate electromagnetic waves and an electric current associated with the wireless communication that can propagate through the wellbore. The modified exterior of the mud motor can reduce the attenuation of the electromagnetic waves and current due to electrical interactions with the outer housing of the mud motor. With less attenuation, more energy associated with each communication can be received by the other transceiver. In this manner, the transceivers can communicate across the mud motor with an improved power transmission efficiency.

In some examples, improving the power transmission efficiency can reduce the power consumed by the transceivers. This can increase the lifespan of the transceivers (which can operate on battery power). Improving the power transmission efficiency can also improve the signal-to-noise ratio of signals communicated between the transceivers. This can enhance the quality of the signals and reduce errors in data associated with (e.g., derived from) the signals.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system 100 that includes band-gap transceivers 118*a*, 118*b* for band-gap communications across a well tool 114 with a modified exterior according to one example. The well system 100 includes a wellbore 102 extending through various earth strata. The wellbore 102 extends through a hydrocarbon bearing subterranean formation 104. A casing string 106 extends from the surface 108 to the subterranean formation 104. The casing string 106 can provide a conduit through which formation fluids, such as production fluids produced from the subterranean formation 104, can travel from the wellbore 102 to the surface 108.

The well system 100 can also include at least one well tool 114 (e.g., a formation-testing tool). The well tool 114 can be coupled to a wireline, slickline, or coiled tube 110 that can be deployed into the wellbore 102, for example, using a winch 112.

The well tool 114 can include a transceiver 118*a* positioned on a subsystem 116 of the well tool 114. The transceiver 118*a* can include a transducer positioned on the subsystem 116. The transducer can include a cylindrically shaped band or one or more electrodes. For example, the transducer can include multiple electrodes positioned around the outer circumference of the subsystem 116. As another example, the transducer can include a cylindrically shaped band positioned coaxially around the subsystem 116. The transducer can include any suitable conductive material (e.g., stainless steel, lead, copper, or titanium).

The well tool 114 can also include another transceiver 118*b* positioned on another subsystem 117. The transceiver 118*b* can include a transducer positioned on the subsystem 117. For example, the transducer can include a cylindrically shaped band positioned coaxially around the outer circumference of the subsystem 117.

The well tool 114 can also include an intermediate subsystem 119. In some examples, the intermediate subsystem 119 can include a mud motor. The transceivers 118*a*, 118*b* can electromagnetically communicate (e.g., wirelessly communicate using electromagnetic fields) across the intermediate subsystem 119.

In some examples, an object can be positioned between one subsystem 116 and the intermediate subsystem 119 and/or between another subsystem 117 and the intermediate subsystem 119. The object can be fluid, another well tool, a component of the well tool 114, a portion of the subterranean formation 104, etc. The wireless coupling of the transceivers 118*a*, 118*b* can allow for a communication path between the transceivers 118*a*, 118*b* that may otherwise be blocked by the object. For example, this communication path may not be possible in traditional wired communications systems, because the object may block a wire from passing between the subsystems 116, 117, 119.

In some examples, one or more of the subsystems 116, 117, 119 can rotate with respect to each other. The wireless coupling of the transceivers 118*a*, 118*b* can generate a communication path between the transceivers 118*a*, 118*b*. This communication path may not be possible in a traditional wired communications system, because the rotation of the subsystems 116, 117, 119 may sever the wire or otherwise prevent the wire from passing between the subsystems 116, 117, 119.

Figure 2A:
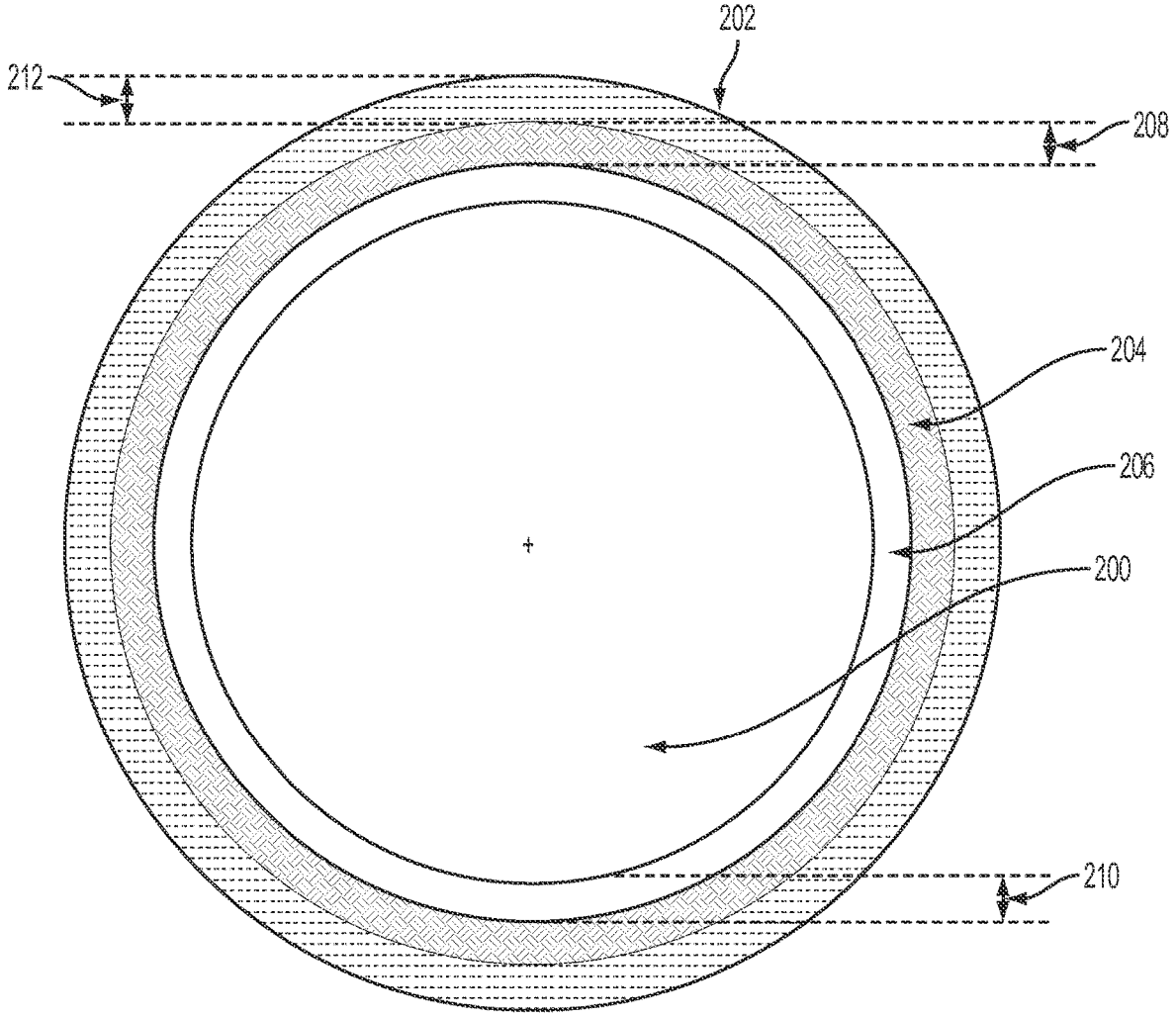
FIG. 2A is a cross-sectional end view of a transducer for use with a transceiver according to one example.

FIG. 2A is a cross-sectional end view of a transducer 202 for use with a transceiver according to one example. In this example, the transducer 202 includes a cylindrically shaped band. The transducer 202 can be positioned around a well tool 200 (e.g., the housing 206 of the well tool 200). In some examples, an insulator 204 can be positioned between the transducer 202 and the housing 206 of the well tool 200. This can prevent the transducer 202 from conducting electricity directly to the well tool 200. The insulator 204 can include any suitable electrically insulating material (e.g., rubber, PEEK, plastic, or a dielectric material).

The diameter of the transducer 202 can be larger than the diameter of the housing 206 of the well tool 200. For example, the diameter of the transducer 202 can be 4.75 inches and the diameter of the housing 206 of the well tool 200 can be 3.2 inches. In some examples, the thickness 212 of the transducer 202 can be thicker or thinner than the thickness 208 of the insulator 204, the thickness 210 of the housing 206 of the well tool 200, or both. For example, the transducer 202 can have a thickness of 0.2 inches.

In some examples, as the length (e.g., length 211 depicted in FIG. 2B) of the transducer 202 increases, the power transmission efficiency can increase. Space limitations (e.g., due to the configuration of the well tool 200), however, can limit the length of the transducer 202. In some examples, the length of the transducer 202 can be the maximum feasible length in view of space limitations. For example, the length of the transducer 202 can be 15.240 cm. This may allow the transducer 202 to fit between components of the well tool 200. The length of the insulator 204 can be the same as or greater than the length of the transducer 202.

In some examples, each of the transducers 118 in the communication system can have characteristics (e.g., the length, thickness, and diameter) that are the same as or different from one another. For example, the transceivers can include transducers 118 with different diameters from one another.

Figure 2B:
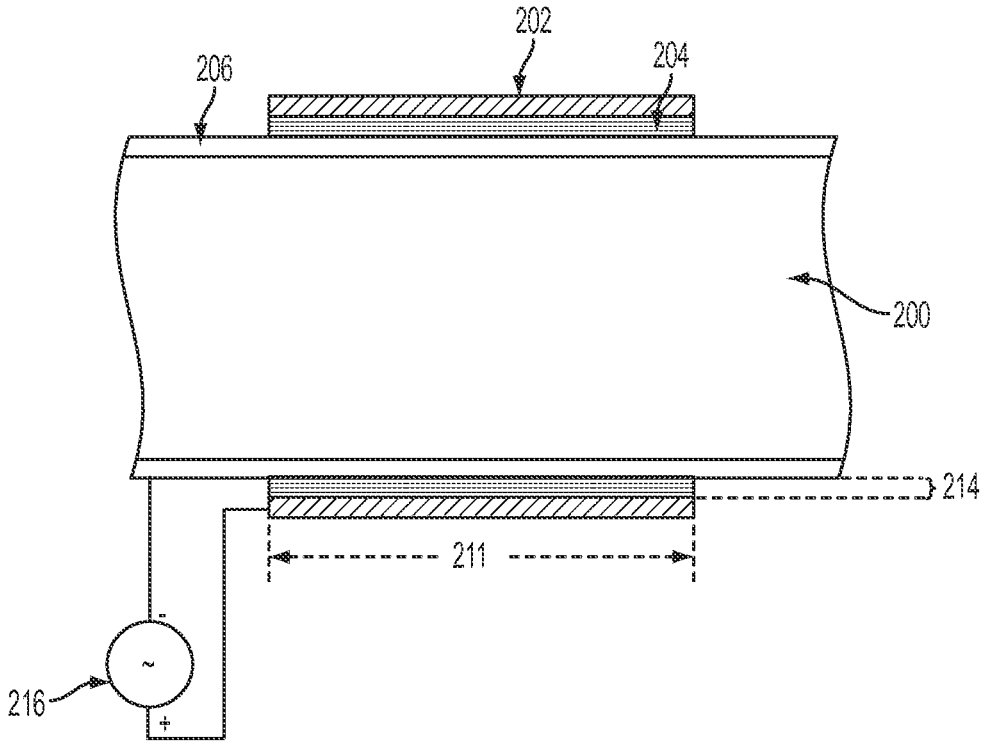
FIG. 2B is a cross-sectional side view of the transducer of FIG. 2A for use with a transceiver according to one example.

FIG. 2B is a cross-sectional side view of the transducer 202 of FIG. 2A for use with a transceiver according to one example. In some examples, the transceiver can apply electricity to the transducer 202 to transmit a wireless signal. For example, the transceiver can include an AC signal source 216. The positive lead of the AC signal source 216 can be coupled to the transducer 202 and the negative lead of the AC signal source 216 can be coupled to the housing 206 of the well tool 200. The AC signal source 216 can generate a voltage 214 between the transducer 202 and the housing 206 of the well tool 200.

The voltage 214 can cause the transducer 202 to radiate an electromagnetic field through a fluid in the wellbore and the formation (e.g., the subterranean formation). The voltage 214 can also cause the cylindrically shaped band to transmit current into the fluid in the wellbore and the formation. If the fluid and formation have a high resistivity, the current can attenuate and the electromagnetic field can propagate through the fluid and the formation with a high power transmission efficiency. This can generate a wireless coupling that is primarily in the form of an electromagnetic field. If the fluid and formation have a low resistivity, the electromagnetic field can attenuate and the current can propagate through the fluid and the formation with a high power transmission efficiency. This can generate a wireless coupling that is primarily in the form of current flowing through the fluid and the formation.

The combination of the electromagnetic field and current can allow the transducer 202 to wirelessly communicate (e.g., wirelessly couple) with another transducer 202 in both low resistivity and high resistivity downhole environments. Further, the combination of the electromagnetic field and current can allow the transducer 202 can transfer the voltage 214 between the transducer 202 and the housing 206 to another transducer 202. This voltage-based wireless coupling can be different from traditional wireless communications systems, which may use coil-based induction for wireless communication.

Figure 3:
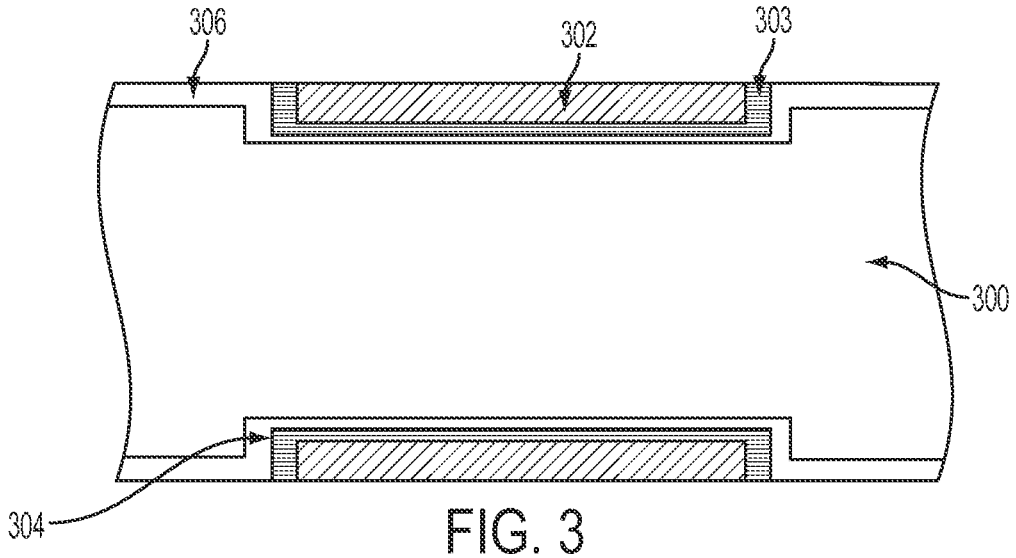
FIG. 3 is a cross-sectional side view of a transducer for use with a transceiver according to one example.

FIG. 3 is a cross-sectional side view of a transducer 302 for use with a transceiver according to one example. In some examples, the housing 306 of the well tool 300 can include a recessed area 304. The transducer 302 can be positioned within the recessed area 304. An insulator 303 can be positioned within the recessed area 304 and between the transducer 302 and the housing 306 of the well tool 300. In some examples, the transducer 302 can operate similarly to the transducer 302 described with respect to FIG. 2.

In some examples, positioning the transducer 302 within the recessed area 304 allows the well tool 300 and transducer 302 to take up less total space in the well system. Further, positioning the transducer 302 within the recessed area 304 can protect the transducer 302 from damage. For example, less of the transducer 302 can be exposed to downhole fluid, temperatures, and impact with other well system components.

Figure 4:
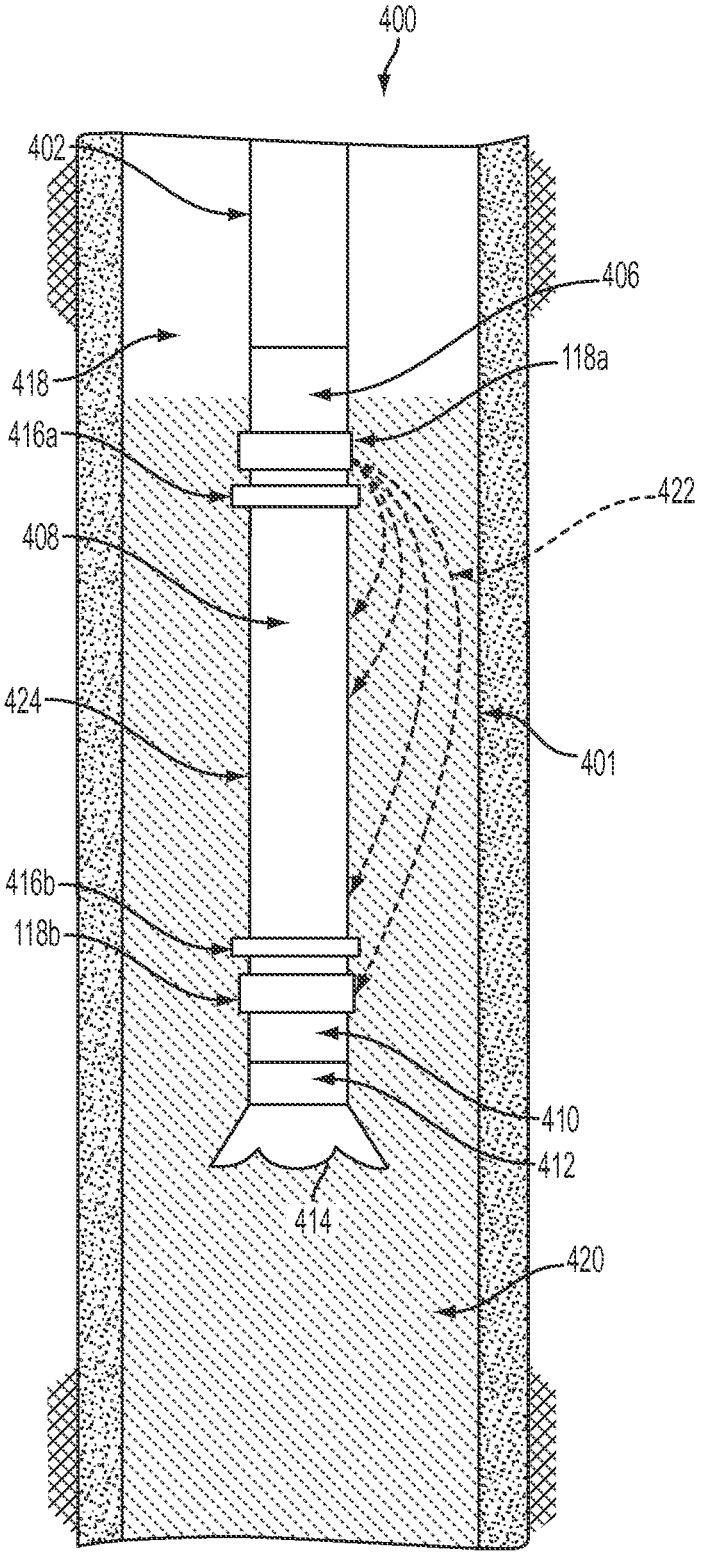
FIG. 4 depicts another well system that includes band-gap transceivers for band-gap communications across a well tool with a modified exterior according to one example.

FIG. 4 depicts another well system 400 that includes band-gap transceivers 118*a*, 118*b* for band-gap communications across a well tool 402 with a modified exterior according to one example. In this example, the well system 400 includes a wellbore 401. A well tool 402 (e.g., logging-while-drilling tool) can be positioned in the wellbore 401. The well tool 402 can include various subsystems 406, 408, 410, 412. For example, the well tool 402 can include a subsystem 406 that includes a communication subsystem. The well tool 402 can also include a subsystem 410 that includes a saver subsystem or a rotary steerable system. A tubular section or an intermediate subsystem 408 (e.g., a mud motor or measuring-while-drilling module) can be positioned between the other subsystems 406, 410. In some examples, the well tool 402 can include a drill bit 414 for drilling the wellbore 401. The drill bit 412 can be coupled to another tubular section or intermediate subsystem 412 (e.g., a measuring-while-drilling module or a rotary steerable system).

The well tool 402 can also include tubular joints 416*a*, 416*b*. Tubular joint 416*a* can prevent a wire from passing between one subsystem 406 and the intermediate subsystem 408. Tubular joint 416*b* can prevent a wire from passing between the other subsystem 410 and the intermediate subsystem 408.

The wellbore 401 can include fluid 420. The fluid 420 (e.g., mud) can flow in an annulus 418 positioned between the well tool 402 and a wall of the wellbore 401. In some examples, the fluid 420 can contact the transceivers 118*a*, 118*b*. This contact can allow for wireless communication between the transceivers 118*a*, 118*b*.

In some examples, one transceiver 118*a* can apply a voltage to an associated transducer to transmit an electromagnetic communication. This can cause the transducer to radiate an electromagnetic field through a fluid in the wellbore 401 and the formation. The voltage can also cause the cylindrically shaped band to transmit current 422 into the fluid in the wellbore and the formation. In some examples, as the electromagnetic field and/or current 422 passes through the fluid and the formation, the electromagnetic field and/or current 422 can electrically interact with the housing 424 of the tubular section or intermediate subsystem 408. For example, a portion of the current 422 can electrically short to through the housing 424 of the intermediate subsystem 408. This may cause the electromagnetic field and/or current 422 to attenuate, reducing the power transmission efficiency of the communication system.

In some examples, the housing 424 of the tubular section or intermediate subsystem 408 can be modified to include an insulator. This can prevent the electromagnetic field and/or current 422 from electrically interacting with the housing 424, which can increase the power transmission efficiency of the transceivers 118*a*, 118*b*. Examples of modifications to the tubular section or intermediate subsystem 408 are described below.

Figure 5:
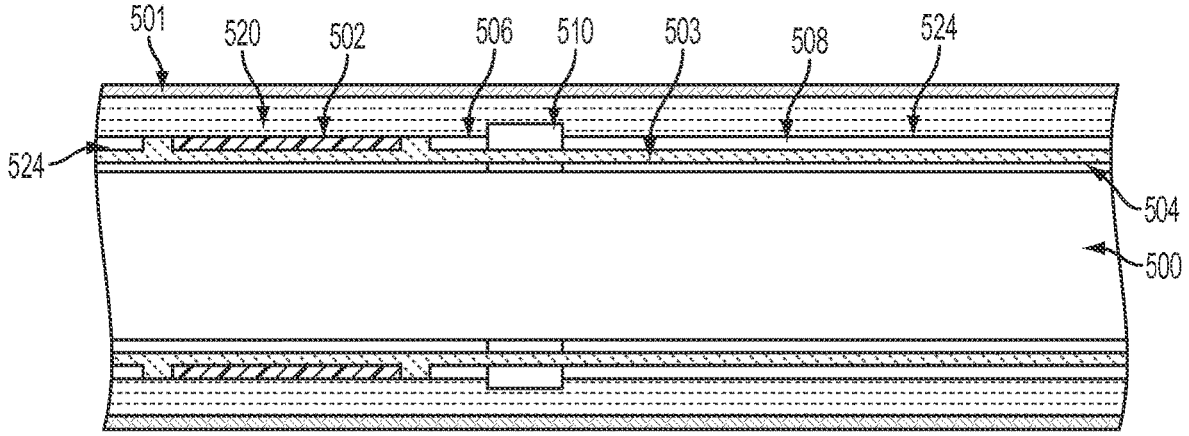
FIG. 5 is a cross-sectional view of a well tool with a modified exterior according to one example.

FIG. 5 is a cross-sectional view of an example of a well tool 500 with a modified exterior according to one example. The well tool 500 can be positioned in a wellbore 501. The well tool 500 can include a subsystem 506, another subsystem 508, and a tubular joint 510 positioned between the subsystems 506, 508 (e.g. similar to the example configuration of FIG. 3).

Fluid 520 can flow through the wellbore 501. The fluid 520 can contact a transducer 502 coupled to a subsystem 506. The transducer 502 can be coaxially positioned around the outer housing 524 of the well tool 500. In some examples, the transducer 502 can be positioned within a recessed area in the outer housing 524 of the well tool 500.

In some examples, the well tool 500 can be completely or partially insulated for reducing attenuation of current and/or electromagnetic waves output by a transducer 502. For example, an insulator 503 can be positioned around an inner mandrel 504 of the well tool 500. The inner mandrel 504 can include a metal material. The insulator 503 can include an insulator sleeve positioned coaxially around the inner mandrel 504 of the well tool 500. The insulator 503 can include any suitable electrically insulating material (e.g., rubber, PEEK, plastic, or a dielectric material). In some examples, the insulator 503 can include an insulating paint, coating, or sleeve. The insulator 503 can traverse the longitudinal length of the well tool 402. For example, the insulator 503 can traverse the longitudinal length of one subsystem 506, another subsystem 508, and the tubular joint 510 between the subsystems 506, 508.

In some examples, an outer housing 524 (e.g., a metal sleeve) can be positioned around the insulator 503. Because the insulator 503 may be unable to endure the hostile environment downhole, the outer housing 524 can protect the insulator 503 (e.g., against chemical and mechanical abrasion). The insulator 503 in combination with the outer housing 524 can form the modified exterior of the well tool 500.

The insulator 503 can electrically insulate the outer housing 524 of the well tool 500 from the inner mandrel 504 of the well tool 500. This can prevent current and/or electromagnetic waves from the transducer 502 from electrically interacting with the inner mandrel 504, causing attenuation. Examples of power transmission efficiency and voltage gains due to modifying the exterior of the well tool 500 are described in FIGS. 6-7.

In some examples, the transducer 502 can generate transverse electromagnetic waves (TEM waves). A TEM wave can be an electromagnetic wave in which the electric field or the magnetic field is transverse to the direction of the transmission of the wave. By positioning (e.g., sandwiching) the insulator 503 between the outer housing 524 and the inner mandrel 504, the outer housing 524 and the inner mandrel 504 can act as a waveguide. The TEM waves can reflect (e.g., bounce) off the outer housing 524 and the inner mandrel 504 to propagate towards a receiving transducer. In this manner, TEM waves can additionally or alternatively be used to wirelessly communicate between transceivers.

Figure 6:
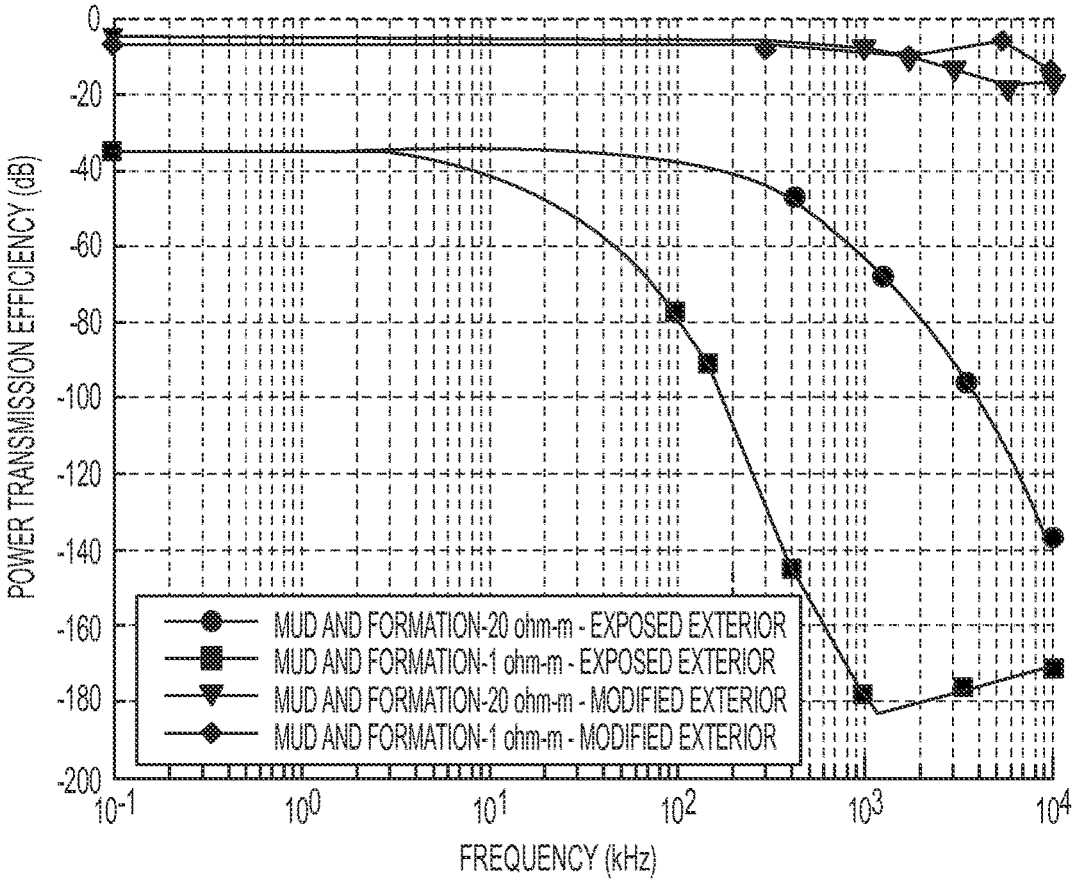
FIG. 6 is a graph depicting power transmission efficiencies of band-gap communications across a well tool with a modified exterior according to one example.

FIG. 6 is a graph depicting power transmission efficiencies of band-gap communications across a well tool with a modified exterior according to one example. In some examples, obstacles in the transmission path of an electromagnetic communication can affect the power transmission efficiency of the electromagnetic communication. For example, the conductivity of a fluid (and the conductivity of the subterranean formation) in the transmission path of an electromagnetic communication can affect the power transmission efficiency of the electromagnetic communication. FIG. 6 depicts examples of power transmission efficiencies when the transmission path (e.g., the mud and the subterranean formation) has a high resistivity (e.g., 20 ohm-m) and when the transmission path has a low resistivity (e.g., 1 ohm-m).

As shown in FIG. 6, the power transmission efficiency is roughly −5 dB when the well tool has a fully insulated exterior (e.g., as shown in FIG. 5), both when communicating through a high resistivity transmission path and when communicating through a low resistivity transmission path. This can be 30 dB higher than the power transmission efficiency when the well tool has an exposed exterior (e.g., when the well tool does not have the insulation layer) and the electromagnetic communications are transmitted at low frequencies (e.g., 5 kHz). This can also be 180 dB higher than the power transmission efficiency when the well tool has an exposed exterior and the electromagnetic communications are transmitted at high frequencies (e.g., 1 MHz).

Figure 7:
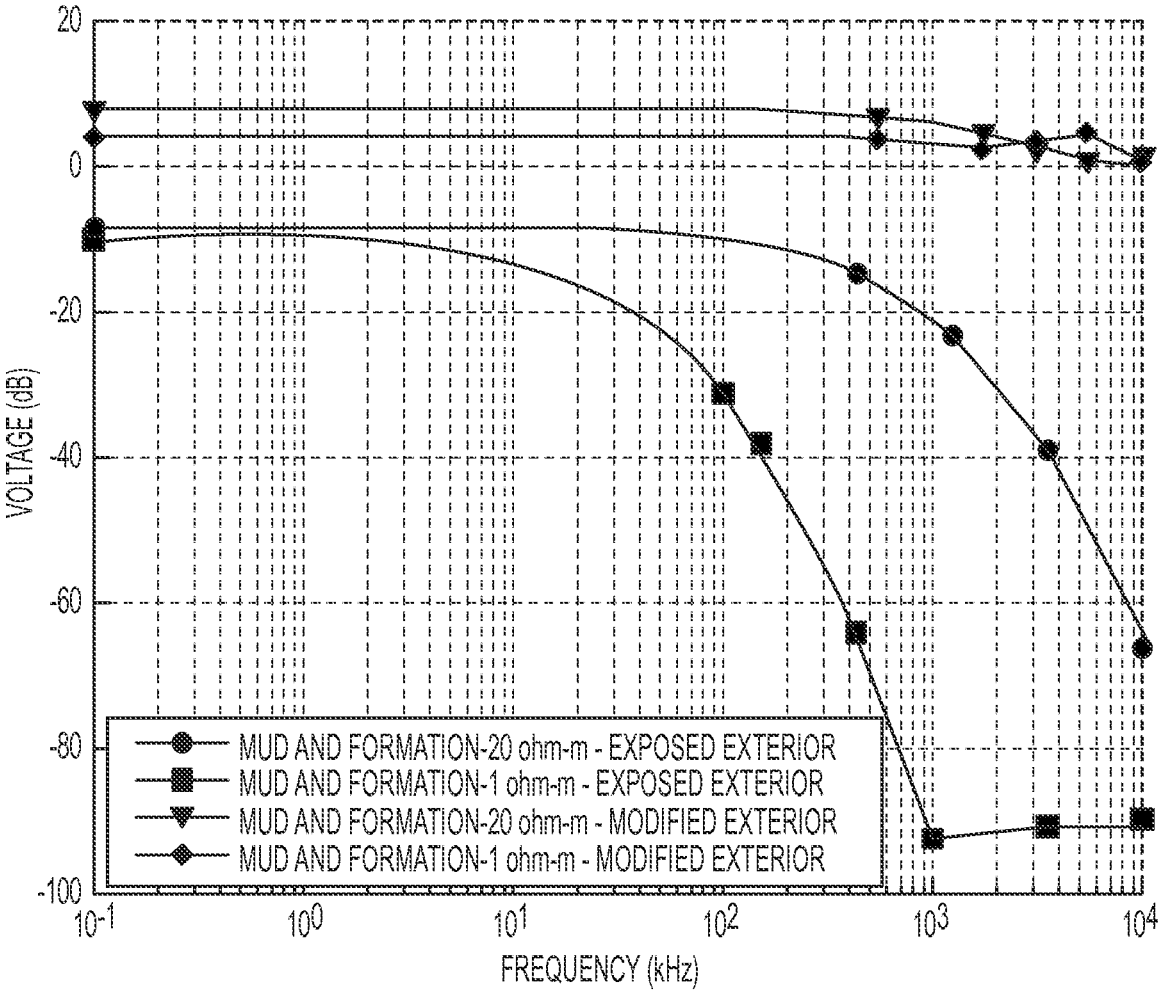
FIG. 7 is a graph depicting voltages of band-gap communications across a well tool with a modified exterior according to one example.

FIG. 7 is a graph depicting voltages of band-gap communications across a well tool with a fully insulated exterior according to one example. As shown in FIG. 7, the voltage of an electromagnetic communication received by a transceiver is between 5 and 8 dB when the well tool has a fully insulated exterior, both when communicating through a high resistivity transmission path and when communicating through a low resistivity transmission path. This can be 15 dB higher than the voltage of an electromagnetic communication received by a transceiver when the well tool has an exposed exterior (e.g., when the well tool does not have the insulation layer) and the electromagnetic communications are transmitted at low frequencies (e.g., 1 kHz). This can also be 95 dB higher than the voltage of an electromagnetic communication received by a transceiver when the well tool has an exposed exterior and the electromagnetic communications are transmitted at high frequencies (e.g., 1 MHz).

In some examples, the minimal voltage level to receive a recognizable electromagnetic communication (e.g., an electromagnetic communication that is not too noisy) can be −30 dB. As shown in FIG. 7, with a fully insulated exterior, the transmission frequency of a recognizable electromagnetic communication can be 10 MHz or higher. In some examples, by being able to transmit recognizable electromagnetic communications at high frequencies, the transceivers can communicate more data (e.g., more than 30 bps) in shorter periods of time.

Figure 8:
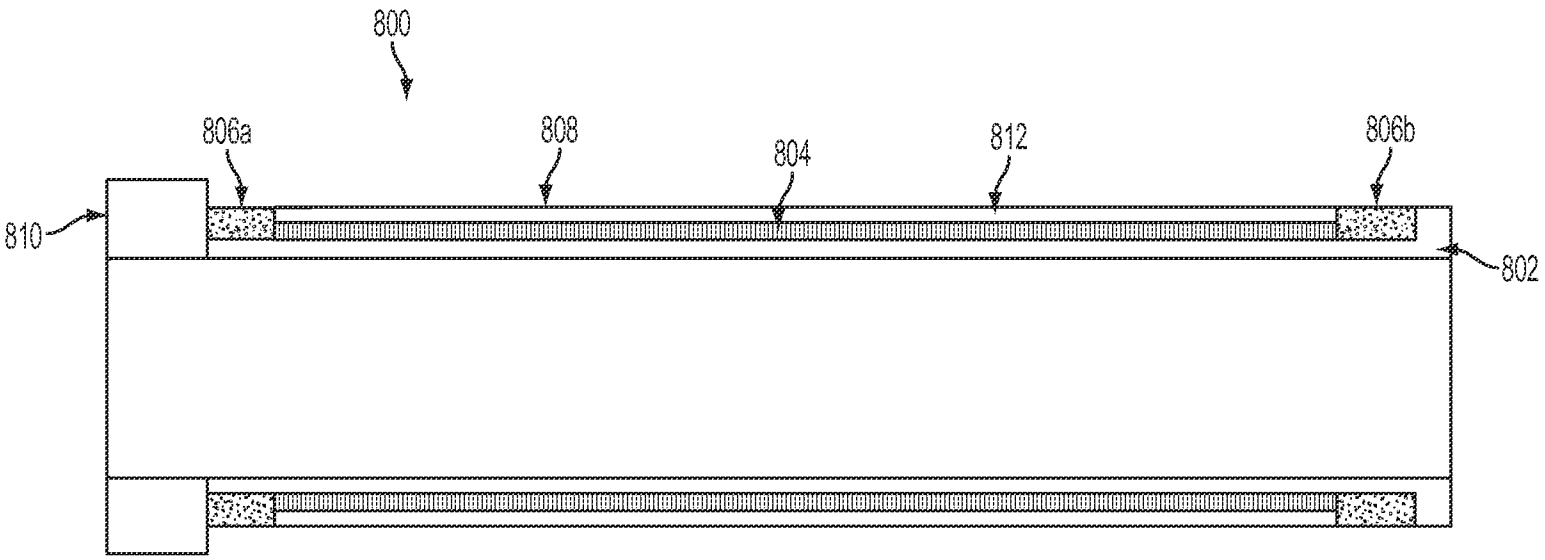
FIG. 8 is a cross-sectional view of a well tool with a modified exterior according to one example.

FIG. 8 is a cross-sectional view of a well tool 800 with a modified exterior according to one example. The well tool

800 can include a subsystem 808. The subsystem 808 can be coupled to a tubular joint 810.

In some examples, the well tool 800 can include an inner mandrel 802. The inner mandrel 802 can include a metal material. An insulator 804 can be positioned around the inner mandrel. The insulator 804 can include any suitable electrically insulating material (e.g., rubber, PEEK, plastic, or a dielectric material).

An outer housing 812 (e.g., a metal sleeve) can be positioned around the insulator 804 and between insulative buffers 806*a*, 806*b*. The insulative buffers 806*a*, 806*b* (e.g., O rings) can be positioned around (e.g., positioned coaxially around) the inner mandrel 802 and near the longitudinal ends of the inner mandrel 802. For example, the insulative buffers 806*a*, 806*b* can be positioned adjacent to either end of the outer housing 812. The insulative buffers 806*a*, 806*b* can include any suitable electrically insulating material (e.g., rubber, PEEK, plastic, or a dielectric material). The insulative buffers 806*a*, 806*b* may or may not include the same insulating material as the insulator 804. The insulative buffers 806*a*, 806*b* and the insulator 804 can electrically isolate the outer housing 812 from the inner mandrel 802 and the tubular joint 810. The outer housing 812 can prevent current and/or electromagnetic waves from electrically interacting with the inner mandrel 802, causing attenuation.

Figure 9:
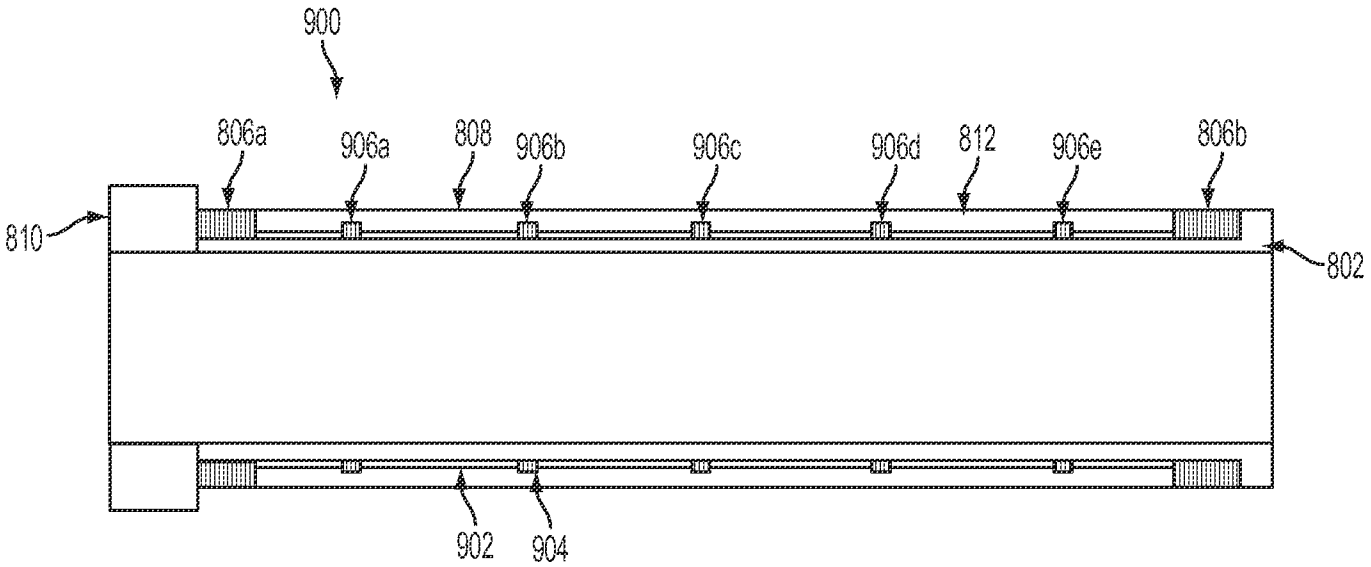
FIG. 9 is a cross-sectional view of a well tool with a modified exterior according to one example.

FIG. 9 is a cross-sectional view of a well tool 900 with a modified exterior according to one example. The well tool 900 can include a subsystem 808. The subsystem 808 can be coupled to a tubular joint 810. The well tool 800 can include an inner mandrel 802. Insulative buffers 806*a*, 806*b* (e.g., O rings) can be positioned around (e.g., positioned coaxially around) the inner mandrel 802. The insulative buffers 806*a*, 806*b* can be positioned adjacent to the outer housing 812. At least one insulative buffer 806*a* can also be positioned adjacent to the tubular joint 810.

The well tool 900 can also include multiple interior insulative buffers 906*a-c*. The interior insulative buffers 906*a-c* (e.g., O rings) can be positioned around (e.g., positioned coaxially around) the inner mandrel 802. In some examples, the interior insulative buffers 906*a-c* can be evenly spaced along the longitude of the inner mandrel 802. The interior insulative buffers 906*a-c* can include any suitable electrically insulating material (e.g., rubber, PEEK, plastic, or a dielectric material). The interior insulative buffers 906*a-c* can create a space 902 between the inner mandrel 802 and an outer housing 812 positioned around the interior insulative buffers 906*a-c*. The space 902 can electrically insulate the outer housing 812 from the inner mandrel 802. This can prevent current and/or electromagnetic waves from electrically interacting with the inner mandrel 802, causing attenuation.

In some examples, the outer housing 812 can include grooves 904 (e.g., slots). The grooves 904 can receive the interior insulative buffers 906*a-c*. The grooves 904 can help position the support the interior insulative buffers 906*a-c*.

Figure 10:
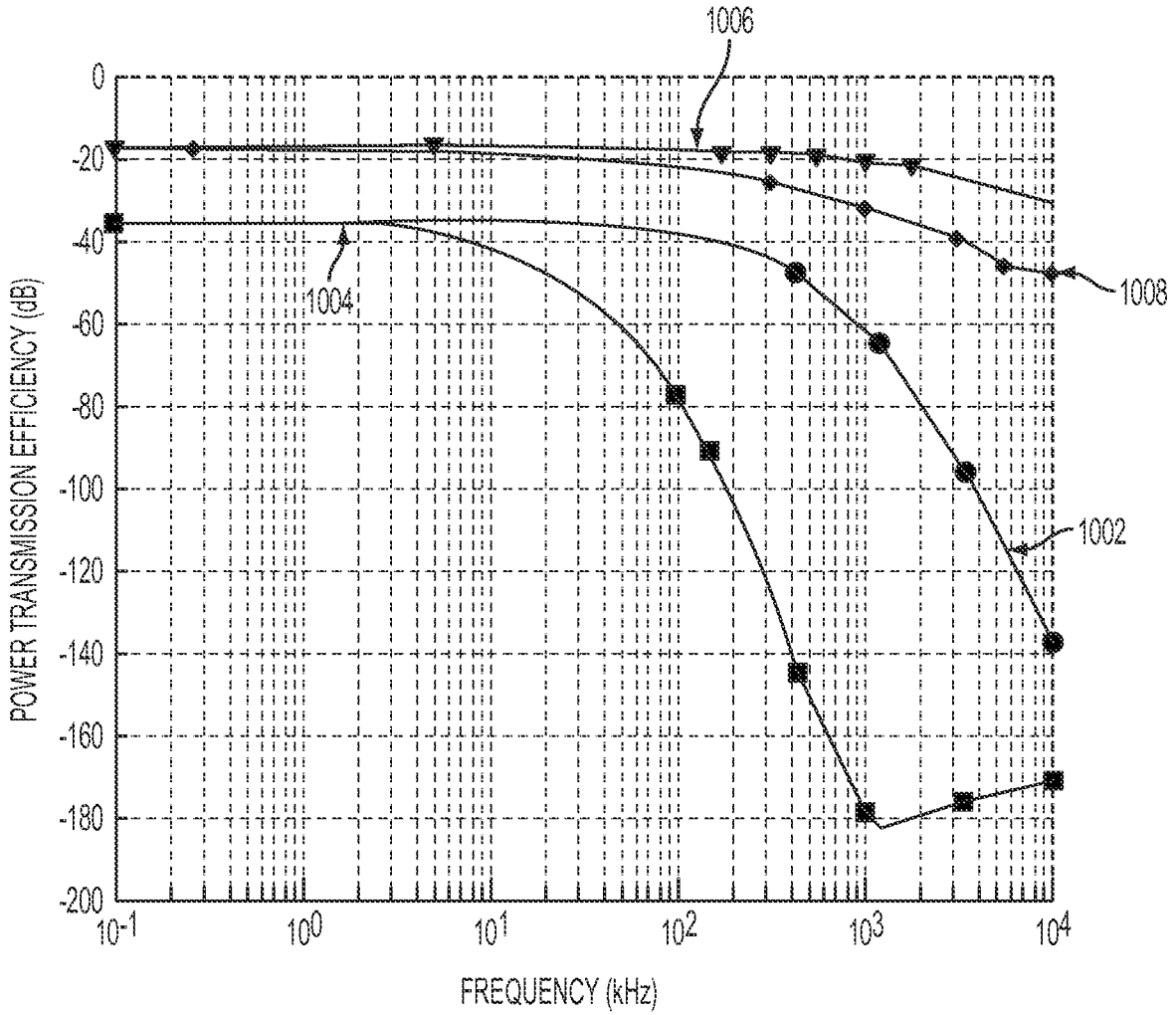
FIG. 10 is a graph depicting power transmission efficiencies of band-gap communications across a well tool with a modified exterior according to one example.

FIG. 10 is a graph depicting power transmission efficiencies of band-gap communications across a well tool with a modified exterior according to one example. Line 1002 depicts an example of power transmission efficiencies when the well tool has an exposed (e.g., uninsulated) outer housing and when the transmission path includes a high resistivity. Line 1004 depicts an example of power transmission efficiencies when the well tool has an exposed outer housing and when the transmission path includes a low resistivity. Line 1006 depicts an example of power transmission efficiencies when the well tool has a partially insulated outer housing (e.g., as shown in FIGS. 8-9) and when the transmission path includes a high resistivity. Line 1008 depicts an example of power transmission efficiencies when the well tool has a partially insulated outer housing and when the transmission path includes a low resistivity.

Figure 11:
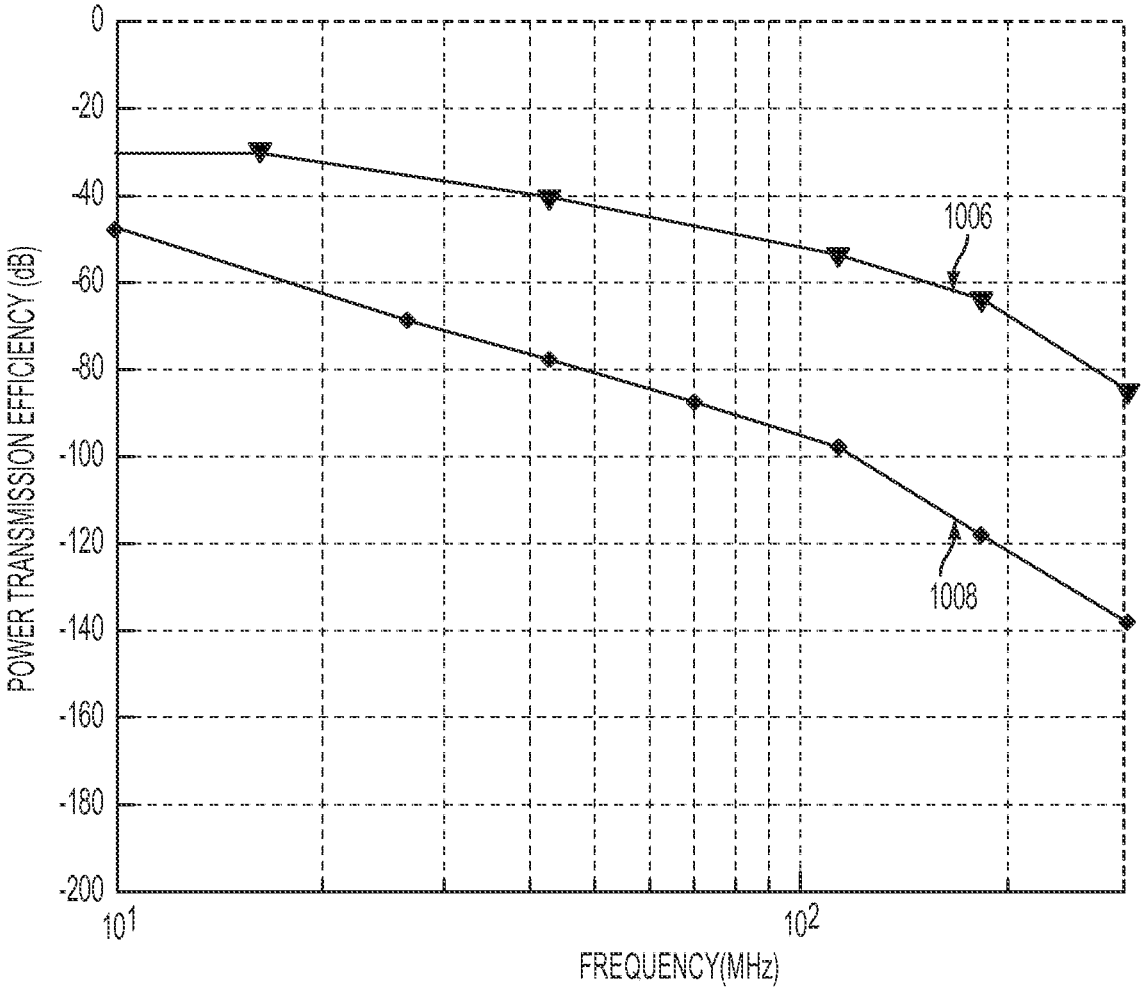
FIG. 11 is a graph depicting power transmission efficiencies of band-gap communications across a well tool with a modified exterior at high frequencies according to one example.

The power transmission efficiency can be between −32 dB and −18 dB when the well tool has a partially insulated outer housing and when electromagnetic communications are transmitted using frequencies up to 1 MHz. Conversely, the power transmission efficiency can be between −180 dB and −60 dB when well tool has an exposed outer housing and when electromagnetic communications are transmitted using frequencies up to 1 MHz. Further, as shown in FIG. 11, the power transmission efficiency can be between −95 dB and −50 dB when the well tool has a partially insulated outer housing and when electromagnetic communications are transmitted using frequencies up to 100 MHz.

Figure 12:
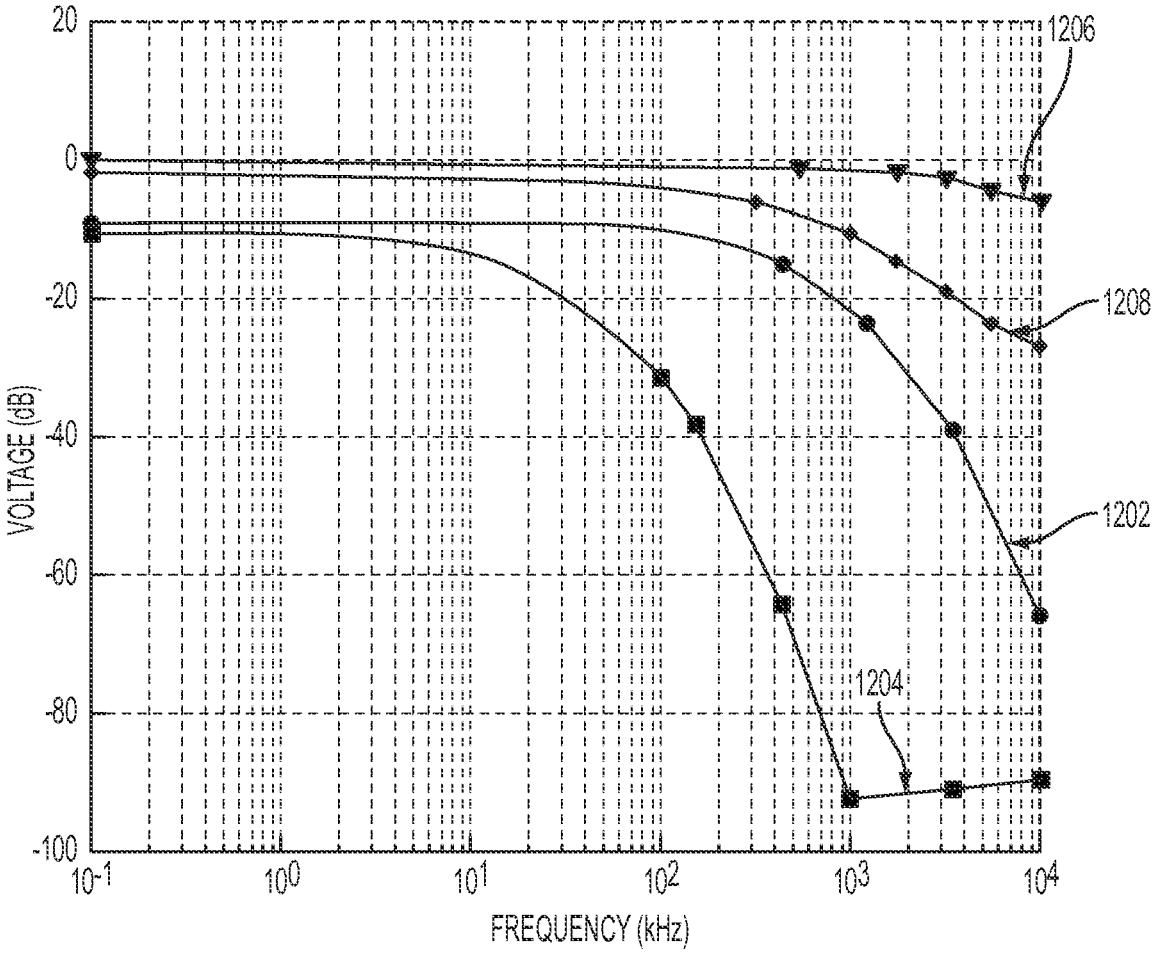
FIG. 12 is a graph depicting voltages of band-gap communications across a well tool with a modified exterior according to one example.

FIG. 12 is a graph depicting voltages of band-gap communications across a well tool with a modified exterior according to one example. Line 1202 depicts voltages of received electromagnetic signals when using a well tool with an exposed outer housing and when the transmission path includes a high resistivity. Line 1204 depicts voltages of received electromagnetic signals when using a well tool with an exposed outer housing and when the transmission path includes a low resistivity. Line 1206 depicts voltages of received electromagnetic signals when using a partially insulated outer housing and when the transmission path includes a high resistivity. Line 1208 depicts voltages of received electromagnetic signals when using a partially insulated outer housing and when the transmission path includes a low resistivity. When the well tool includes a partially insulated outer housing, the transceivers can receive electromagnetic signals with higher voltages at higher frequencies (e.g., frequencies greater than 1 MHz) than when the well tool includes an exposed outer housing. This can occur both when the transmission path has a low resistivity and when the transmission path has a high resistivity.

Figure 13:
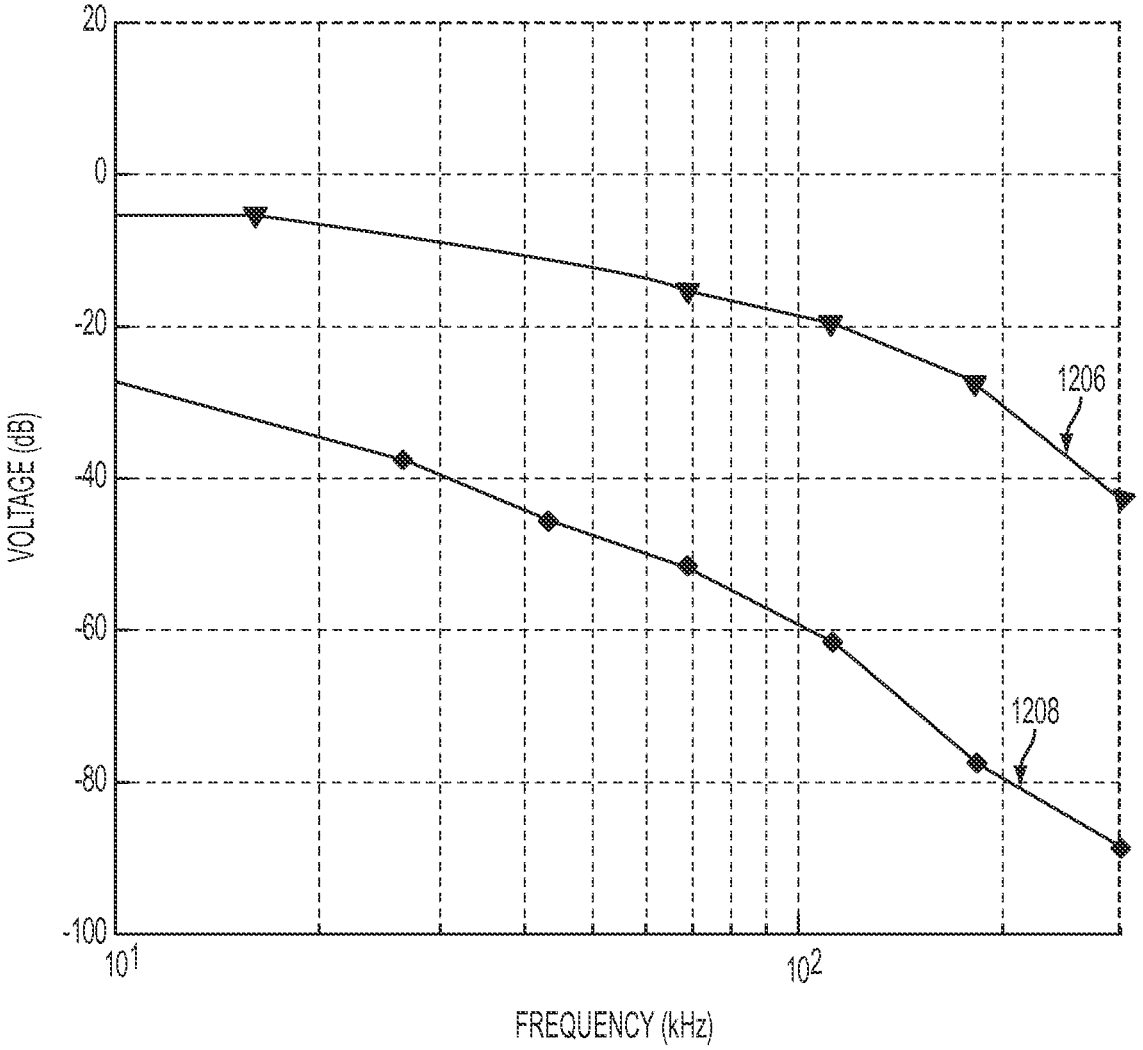
FIG. 13 is a graph depicting voltages of band-gap communications across a well tool with a modified exterior at high frequencies according to one example.

In some examples, the minimal voltage level to receive a recognizable electromagnetic communication (e.g., a wireless communication that is not too noisy) can be −30 dB. As shown in FIG. 12, using a well tool with a partially insulated outer housing, the transmission frequency of a recognizable electromagnetic communication can be higher than 10 MHz when communicated through a transmission path with either a low resistivity or a high resistivity. As shown in FIG. 13, using a well tool with a partially insulated outer housing, the transmission frequency of a recognizable electromagnetic communication can be higher than 200 MHz when communicated through a high resistivity transmission path. The transmission frequency of a recognizable electromagnetic communication can be higher than 15 MHz when communicated through a low resistivity transmission path. In some examples, by being able to transmit recognizable electromagnetic communications at high frequencies, the transceivers can communicate more data (e.g., more than 30 bps) in shorter periods of time.

Figure 14:
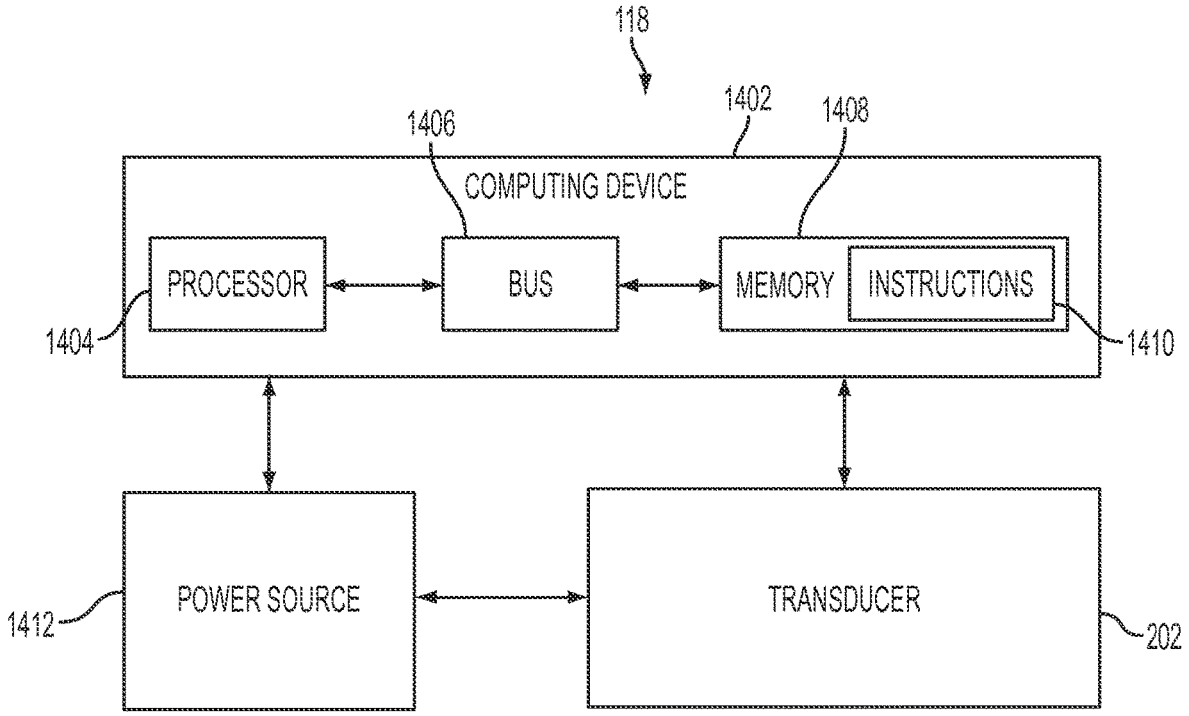
FIG. 14 is a block diagram of a transceiver that can communicate across a well tool with a modified exterior.

FIG. 14 is a block diagram of a transceiver that can transmit communicate across a well tool with a modified exterior. In some examples, the components shown in FIG. 14 (e.g., the computing device 1402, power source 1412, and transducer 202) can be integrated into a single structure. For example, the components can be within a single housing. In other examples, the components shown in FIG. 14 can be distributed (e.g., in separate housings) and in electrical communication with each other.

The transceiver 118 can include a computing device 1402. The computing device 1402 can include a processor 1404, a memory 1408, and a bus 1406. The processor 1404 can execute one or more operations for operating a transceiver. The processor 1404 can execute instructions 1410 stored in the memory 1408 to perform the operations. The processor 1404 can include one processing device or multiple processing devices. Non-limiting examples of the processor 1404 include a Field-Programmable Gate Array ("FPGA"), an application-specific integrated circuit ("ASIC"), a microprocessor, etc.

The processor 1404 can be communicatively coupled to the memory 1408 via the bus 1406. The non-volatile memory 1408 may include any type of memory device that retains stored information when powered off. Non-limiting examples of the memory 1408 include electrically erasable and programmable read-only memory ("EEPROM"), flash memory, or any other type of non-volatile memory. In some examples, at least some of the memory 1408 can include a medium from which the processor 1404 can read the instructions 1410. A computer-readable medium can include electronic, optical, magnetic, or other storage devices capable of providing the processor 1404 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions may include processor-specific instructions generated by a compiler or an interpreter from code written in any suitable computer-programming language, including, for example, C, C++, C#, etc.

The transceiver 118 can include a power source 1412. The power source 1412 can be in electrical communication with the computing device 1402 and the transducer 202. In some examples, the power source 1412 can include a battery (e.g. for powering the transceiver 118). In other examples, the transceiver 118 can be coupled to and powered by an electrical cable (e.g., a wireline).

Additionally or alternatively, the power source 1412 can include an AC signal generator. The computing device 1402 can operate the power source 1412 to apply a transmission signal to the transducer 202. For example, the computing device 1402 can cause the power source 1412 to apply a modulated series of voltages to the transducer 202. The modulated series of voltages can be associated with data to be transmitted to another transceiver 118. The transducer 202 can receive the modulated series of voltages and transmit the data to the other transducer 202. In other examples, the computing device 1402, rather than the power source 1412, can apply the transmission signal to the transducer 202.

The transceiver 118 can include a transducer 202. As described above, a voltage can be applied to the transducer 202 (e.g., via power source 1412) to cause the transducer 202 to transmit data to another transducer 202 (e.g., a transducer 202 associated with another transceiver).

In some examples, the transducer 202 can receive an electromagnetic transmission. The transducer 202 can communicate data (e.g., voltages) associated with the electromagnetic transmission to the computing device 1402. In some examples, the computing device 1402 can analyze the data and perform one or more functions. For example, the computing device 1402 can generate a response based on the data. The computing device 1402 can cause a response signal associated with the response to be transmitted to the transducer 202. The transducer 202 can communicate the response to another transceiver 118. In this manner, the computing device 1402 can receive, analyze, and respond to communications from another transceiver 118.

Figure 15:
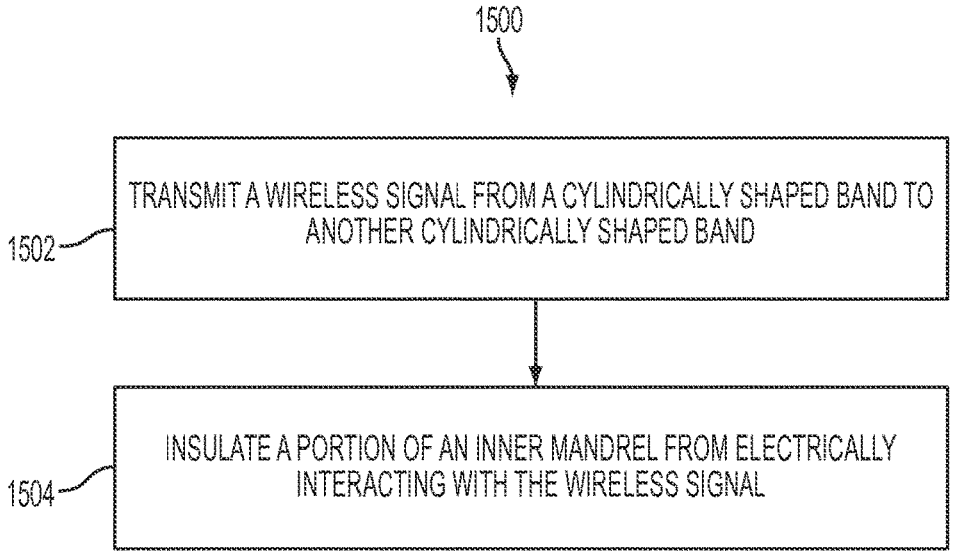
FIG. 15 is a flow chart showing an example of a process for producing a well tool with a modified exterior according to one example.

FIG. 15 is a flow chart showing an example of a process for producing a well tool with a modified exterior according to one example.

In block 1502, a cylindrically shaped band transmits a wireless signal (e.g., an electromagnetic signal) to another cylindrically shaped band. One cylindrically shaped band can be associated with one subsystem and the other cylindrically shaped band can be associated with the other subsystem. The subsystems can be well tool subsystems. In some examples, the cylindrically shaped band can radiate an electromagnetic field to transmit the wireless signal. In other examples, the cylindrically shaped band can apply current to a fluid (e.g., in a wellbore and between the cylindrically shaped bands) and the formation to transmit the wireless signal.

In block 1504, a portion of an inner mandrel can be insulated from electrically interacting with the wireless signal. In some examples, insulating can include completely eliminating the electrical interaction of the wireless signal with the inner mandrel. In other examples, insulating can include substantially reducing but not completely eliminating the electrical interaction of the wireless signal with the inner mandrel.

The portion of the inner mandrel can be insulated from electrically interacting with the wireless signal via an insulator positioned around a portion of the inner mandrel. The inner mandrel can be associated with an intermediate subsystem (e.g., a mud motor) that can be positioned between the other subsystems. A cylindrically shaped band can transmit the wireless signal across the intermediate subsystem with reduced attenuation due to the insulator.

In some aspects, band-gap communications across a well tool with a modified exterior is provided according to one or more of the following examples:

Example #1

A communication system can include a first subsystem of a well tool. The first subsystem can include a first cylindrically shaped band positioned around the first subsystem and operable to electromagnetically couple with a second cylindrically shaped band. The communication system can also include a second subsystem of the well tool. The second subsystem can include the second cylindrically shaped band being positioned around the second subsystem. The communication system can also include an intermediate subsystem positioned between the first subsystem and the second subsystem. The intermediate subsystem can include an insulator positioned coaxially around the intermediate subsystem.

Example #2

The communication system of Example #1 may feature the intermediate subsystem including a mud motor and a tubular joint being positioned between the first subsystem and the intermediate subsystem.

Example #3

The communication system of any of Examples #1-2 may feature a metal sleeve being positioned coaxially around the insulator.

Example #4

The communication system of Example #3 may feature the insulator being included in multiple insulators positioned between an inner mandrel of the intermediate subsystem and the metal sleeve.

Example #5

The communication system of Example #4 may feature the metal sleeve including multiple grooves for receiving the multiple insulators. The multiple insulators can be operable to create a space between the inner mandrel and the metal sleeve.

Example #6

The communication system of any of Examples #3-5 may feature two insulative buffers being positioned around an inner mandrel and at opposite longitudinal ends of the metal sleeve from one another.

Example #7

The communication system of Example #6 may feature one of the two insulative buffers being positioned adjacent to a tubular joint.

Example #8

The communication system of any of Examples #1-3 may feature two insulative buffers being positioned around an inner mandrel of the intermediate subsystem and at opposite longitudinal ends of the metal sleeve from one another. The insulator can extend along a full longitudinal length of the inner mandrel between the two insulative buffers. One of the two insulative buffers can be positioned adjacent to a tubular joint.

Example #9

The communication system of any of Examples #1-8 may feature the insulator being operable to electrically insulate a metal sleeve from the intermediate subsystem.

Example #10

The communication system of any of Examples #1-9 may feature the insulator being operable to separate a metal sleeve from an inner mandrel of the intermediate subsystem.

Example #11

An assembly can include an inner mandrel positioned within an intermediate subsystem of a well tool. The assembly can also include an insulator positioned coaxially around the inner mandrel. The assembly can further include a metal sleeve positioned coaxially around the insulator and making up an outer housing of the intermediate subsystem. The assembly can also include two insulative buffers positioned coaxially around the inner mandrel and at opposite longitudinal ends of the metal sleeve from one another.

Example #12

The assembly of Example #11 may feature the intermediate subsystem including a mud motor and one of the two insulative buffers being positioned adjacent to a tubular joint.

Example #13

The assembly of any of Examples #11-12 may feature the insulator being included in multiple insulators positioned between the inner mandrel and the metal sleeve.

Example #14

The assembly of any of Examples #11-13 may feature the metal sleeve including multiple grooves for receiving multiple insulators. The multiple insulators can be operable to create a space between the inner mandrel and the metal sleeve.

Example #15

The assembly of any of Examples #11-14 may feature the insulator being operable to electrically insulate the metal sleeve from the intermediate subsystem.

Example #16

The assembly of any of Examples #11-15 may feature the insulator being operable to separate the metal sleeve from the inner mandrel.

Example #17

The assembly of any of Examples #11-16 may feature a first cylindrically shaped band being positioned around a first subsystem of the well tool. The first cylindrically shaped band can be operable to electromagnetically couple with a second cylindrically shaped band. The second cylindrically shaped band can be positioned around a second subsystem of the well tool. The intermediate subsystem can be positioned between the first subsystem and the second subsystem.

Example #18

A method can include transmitting an electromagnetic signal, by a cylindrically shaped band associated with a first subsystem of a well tool, to another cylindrically shaped band associated with a second subsystem of the well tool. The method can also include insulating, by an insulator positioned around an intermediate subsystem that is positioned between the first subsystem and the second subsystem, a portion of an inner mandrel of the intermediate subsystem from electrically interacting with the electromagnetic signal.

Example #19

The method of Example #18 may feature the insulator being included within multiple insulators positioned coaxially around the inner mandrel of the intermediate subsystem. A metal sleeve can be positioned coaxially around the multiple insulators and can include multiple grooves for receiving the multiple insulators. The multiple insulators can separate the inner mandrel from the metal sleeve.

Example #20

The method of any of Examples #18-19 may feature the intermediate subsystem including a mud motor. The method may also feature two insulative buffers being positioned at opposite longitudinal ends of a metal sleeve coaxially surrounding the insulator. One of the two insulative buffers can be positioned adjacent to a tubular joint.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A communication system comprising:

a first subsystem of a well tool, the first subsystem comprising a first transceiver, the first transceiver including a first cylindrically shaped band positioned around the first subsystem and operable to electromagnetically couple with a second transceiver;

a second subsystem of the well tool, the second subsystem comprising the second transceiver, the second transceiver including a second cylindrically shaped band positioned around the second subsystem; and an intermediate subsystem that is external to the first subsystem and the second subsystem and positioned between the first subsystem and the second subsystem, wherein the intermediate subsystem comprises an insulator positioned coaxially around the intermediate subsystem.

2. The communication system of claim 1, wherein the intermediate subsystem comprises a mud motor and wherein a tubular joint is positioned between the first subsystem and the intermediate subsystem.

3. The communication system of claim 1, wherein a metal sleeve is positioned coaxially around the insulator, and the metal sleeve is separate from the first transceiver and the second transceiver.

4. The communication system of claim 3, wherein the insulator is included in a plurality of insulators positioned between an inner mandrel of the intermediate subsystem and the metal sleeve, each insulator in the plurality of insulators contacting the metal sleeve.

5. The communication system of claim 4, wherein the metal sleeve comprises a plurality of grooves for receiving the plurality of insulators, and wherein the plurality of insulators are operable to create a space between the inner mandrel and the metal sleeve.

6. The communication system of claim 5, wherein two insulative buffers are positioned around the inner mandrel and at opposite longitudinal ends of the metal sleeve from one another.

7. The communication system of claim 6, wherein one of the two insulative buffers is positioned adjacent to a tubular joint.

8. The communication system of claim 3, wherein two insulative buffers are positioned around an inner mandrel of the intermediate subsystem and at opposite longitudinal ends of the metal sleeve from one another, wherein the insulator extends along a full longitudinal length of the inner mandrel between the two insulative buffers, and wherein one of the two insulative buffers is positioned adjacent to a tubular joint.

9. The communication system of claim 3, wherein the insulator is operable to separate and electrically insulate the metal sleeve from the intermediate subsystem.

10. An assembly comprising:

an inner mandrel positioned within an intermediate subsystem of a well tool;

a plurality of insulators positioned coaxially around the inner mandrel; and a metal sleeve positioned coaxially around the plurality of insulators and making up an outer housing of the intermediate subsystem, wherein each insulator among the plurality of insulators contacts the metal sleeve, and wherein the metal sleeve is electrically isolated from the inner mandrel.

11. The assembly of claim 10, wherein the intermediate subsystem comprises a mud motor.

12. The assembly of claim 10, wherein the metal sleeve comprises a plurality of grooves for receiving the plurality of insulators, and wherein the plurality of insulators are operable to create a space between the inner mandrel and the metal sleeve.

13. The assembly of claim 10, wherein each insulator in the plurality of insulators is operable to electrically insulate the metal sleeve from the intermediate subsystem.

14. The assembly of claim 10, wherein each insulator in the plurality of insulators is operable to separate the metal sleeve from the inner mandrel.

15. The assembly of claim 10, wherein a first transceiver is positioned around a first subsystem of the well tool and operable to electromagnetically couple with a second transceiver positioned around a second subsystem of the well tool, wherein the intermediate subsystem is positioned between the first subsystem and the second subsystem.

16. A communication system comprising:

a first subsystem of a well tool, the first subsystem comprising a first cylindrically shaped band positioned around the first subsystem and operable to transmit a data communication, the data communication comprising a plurality of bits;

a second subsystem of the well tool, the second subsystem comprising a second cylindrically shaped band positioned around the second subsystem and operable to receive the data communication; and an intermediate subsystem that is external to the first subsystem and the second subsystem and positioned between the first subsystem and the second subsystem, wherein the intermediate subsystem comprises an insulator positioned coaxially around the intermediate subsystem.

17. The communication system of claim 16, wherein the first cylindrically shaped band is a first transceiver and the second cylindrically shaped band is a second transceiver.

18. The communication system of claim 16, further comprising:

a metal sleeve that is positioned coaxially around the insulator, the metal sleeve being different from the first cylindrically shaped band and the second cylindrically shaped band; and a plurality of insulators positioned between an inner mandrel of the intermediate subsystem and the metal sleeve, each insulator in the plurality of insulators contacting the metal sleeve.

19. A communication system comprising:

a first subsystem of a well tool, the first subsystem comprising a first cylindrically shaped band positioned around the first subsystem and operable to electromagnetically couple with a second cylindrically shaped band;

a second subsystem of the well tool, the second subsystem comprising the second cylindrically shaped band positioned around the second subsystem; and an intermediate subsystem positioned between the first subsystem and the second subsystem, wherein the intermediate subsystem comprises an insulator positioned coaxially around the intermediate subsystem, and wherein a tubular joint is positioned between the first subsystem and the intermediate subsystem.

20. The communication system of claim 19, wherein the first cylindrically shaped band is a first transceiver and the second cylindrically shaped band is a second transceiver.

21. A communication system comprising:

a first subsystem of a well tool, the first subsystem comprising a first transceiver, the first transceiver including a first cylindrically shaped band positioned around the first subsystem and operable to electromagnetically couple with a second transceiver;

a second subsystem of the well tool, the second subsystem comprising the second transceiver, the second transceiver including a second cylindrically shaped band positioned around the second subsystem; and an intermediate subsystem positioned between the first subsystem and the second subsystem, wherein the intermediate subsystem comprises an insulator positioned coaxially around the intermediate subsystem, and wherein the intermediate subsystem comprises a motor.

* * * * *